US010000313B2

(12) United States Patent
Sytnik

(10) Patent No.: US 10,000,313 B2
(45) Date of Patent: Jun. 19, 2018

(54) HOLDER WITH BOTTLE

(71) Applicant: Obschestvo s ogranichennoi otvetstvenostju "Mistral Alko", Moscow (RU)

(72) Inventor: Liviu Sytnik, Kishenev (MD)

(73) Assignee: Obschestvo s organichennoi otvetstvenostju "Mistral Alko", Moscow (RU)

( * ) Notice: Subject to any disclaimer, the term of this patent is extended or adjusted under 35 U.S.C. 154(b) by 0 days. days.

(21) Appl. No.: 15/519,741

(22) PCT Filed: Sep. 19, 2016

(86) PCT No.: PCT/RU2016/000629
§ 371 (c)(1),
(2) Date: Apr. 17, 2017

(87) PCT Pub. No.: WO2017/164766
PCT Pub. Date: Sep. 28, 2017

(65) Prior Publication Data

US 2018/0093798 A1 Apr. 5, 2018

(30) Foreign Application Priority Data

Mar. 23, 2016 (RU) ..... 2016110520

(51) Int. Cl.
*B65D 23/00* (2006.01)
*B65D 23/04* (2006.01)
*B65D 1/02* (2006.01)

(52) U.S. Cl.
CPC ..... *B65D 23/04* (2013.01); *B65D 1/02* (2013.01)

(58) Field of Classification Search
CPC ..... B65D 23/04; B65D 1/02; B65D 23/003; B65D 23/00; B65D 8/00; B65D 41/04;
(Continued)

(56) References Cited

U.S. PATENT DOCUMENTS 711,339 A * 10/1902 Park ..... A47G 23/0241 248/141
1,400,025 A * 12/1921 Carey ..... B67C 9/00 180/68.5

(Continued)

FOREIGN PATENT DOCUMENTS

CN 201287869 Y 8/2009

*Primary Examiner* — Jennifer Eleanore Novosad
(74) *Attorney, Agent, or Firm* — Nadya Reingand; Yan Hankin

(57) ABSTRACT

The present invention comprises a frame structure supporting stand with swing joint elements and a bottle with necks for pouring out the contents and tubes for overflow of the contents. The bottle is attached to a frame consisting of vertical rods mounted between two support platforms within which the bottle is placed. The bottle is attached to the frame through the support platforms. The frame is positioned on the holder axes with the possibility of rotation about the holder due to the swing joint. Additional external elements are provided on the support platforms, and they allow opening/closing of the bottle neck. The holder has a mounting stand. The swing joints of the holder and the frame are configured to fix the frame with the bottle in the desired position relative to the axis of the holder.

1 Claim, 1 Drawing Sheet

(58) Field of Classification Search
CPC ..... B65D 3/00; B65D 3/0029; B65D 3/0032; B65D 3/0035; B67D 3/0029; B67D 3/0051; B65G 5/23; B65G 5/24; A47F 7/28; A47F 7/285; A47B 73/00; A47B 73/004; A47G 23/0241; A47G 23/02; A47G 23/0216; A47G 19/2205; A47G 19/2222; A47G 19/2255
USPC ..... 211/119.006, 74, 13.1; 248/135–142, 248/311.3, 312, 311.2, 312.1; 215/11.1, 215/11.5, 378, 383, 388, 380; 222/454
See application file for complete search history.

(56) References Cited

U.S. PATENT DOCUMENTS 1,538,693 A * 5/1925 Gilbert ..... A47G 23/0241 248/141
1,742,041 A * 12/1929 Mangold ..... B67C 9/00 248/141
2,467,866 A * 4/1949 Smolderen ..... A47B 81/007 141/375
2,470,154 A * 5/1949 Fitzgerald ..... A47G 23/0241 248/141
4,288,007 A * 9/1981 Rogers ..... B67D 3/00 141/376
D331,174 S * 11/1992 Polski ..... D7/621
5,720,456 A * 2/1998 Szybura ..... B23K 7/10 248/126
5,829,607 A * 11/1998 Ibrahim ..... B65D 1/0223 215/228
5,890,686 A * 4/1999 Morales ..... B65D 85/302 215/395
6,202,970 B1 * 3/2001 Dunbar ..... A23G 3/34 248/311.3
6,889,945 B2 * 5/2005 McCall ..... A47G 23/0241 222/144
7,344,112 B2 * 3/2008 Nice ..... B67D 7/845 248/125.1
7,467,768 B1 * 12/2008 Vait ..... B65F 1/141 211/71.01
8,136,779 B2 * 3/2012 Wilson ..... A61F 9/00736 222/105
8,567,617 B1 10/2013 Tapager
2005/0274735 A1 * 12/2005 Patel ..... B67D 3/0029 222/83.5
2007/0175773 A1 8/2007 Spellman
2008/0290040 A1 * 11/2008 Kane ..... B01D 29/05 210/741
2013/0068771 A1 3/2013 Tong

* cited by examiner

HOLDER WITH BOTTLE

CROSS REFERENCE TO RELATED APPLICATIONS

The present application is a National stage application from PCT application PCT/RU2016/000629 filed on Sep. 19, 2016, which claims priority to Russian application RU2016110520 filed on Mar. 23, 2016.

FIELD OF THE INVENTION

The present invention relates to devices for liquid storing and using, namely a frame structure with swing joint elements and a bottle with necks for pouring out the contents.

BACKGROUND OF THE INVENTION

From the related art, a "Double-sided bottle" is known. (See US Patent for the Invention No. 5829607, IPC B65D8/00, B65D41/04.)

The double-sided bottle is made in the form of a container with a neck and shoulders in its upper and lower parts.

The disadvantageous feature of this solution is the inconvenience of liquid pouring out.

The closest prior art to the claimed invention is the RF patent for utility model No. 28104, IPC B65D1/02. "Bottle". This prior art comprises a bottle having a body with a container for liquid inside, which is rigidly fixed to the body by means of a neck; the bottle is characterized by the fact that the container is made as two connecting vessels in the form of truncated cones connected by peaks, the body is fixed in the frame on axes with the possibility of turning about the axis of the frame, and the frame is made in the form of vertical rods, installed between two support platforms. The axles ends are equipped with handles for turning the body about the frame. The body has the shape of a polyhedron or cylinder. The rods are cylindrical or polyhedral. Support platforms are made round or in the form of a polygon.

The disadvantage of this technical solution is the impossibility of fixing the bottle in a desired position, resulting in an uncontrolled liquid pouring out, as well as the absence of the possibility of pouring liquid from both sides of the bottle.

SUMMARY OF THE INVENTION

An object of the present invention is creation of the bottle holder that allows the liquid to be poured from the top or bottom side of the bottle, to fix the bottle in the desired position in order to control the liquid pouring rate, and also to provide liquid transfer from one of the connecting vessels to another at a predetermined rate.

The task is achieved due to the fact that the holder with the bottle contains a frame consisting of vertical rods mounted between two support platforms within which the bottle is placed. The bottle is attached to the frame through a support platform. The frame is fixed on the holder axes with the possibility of rotation about the holder due to the swing joint. Additional external elements are provided on the support platforms, they allow opening/closing of the bottle neck. The holder has a mounting stand. The swing joints of the holder and the frame are configured to fix the frame with the bottle in the desired position relative to the axis of the holder. The bottle is made in the form of two connecting vessels, the vessels being connected by their peaks (i.e., connected at their rims, or their truncated portions), it has two necks, one neck being located at the bottom of the bottle, and the other neck being located at the top of the bottle. Inside the bottle, two tubes are fixed at the place of the vessels' connection, the large (i.e. longer) end of the first tube goes into the upper vessel, and the large (i.e. longer) end of the second tube goes into the lower vessel, ensuring the air pressure on the poured liquid. The tubes are fixed in the place of the vessels' connection in such a way that the liquid penetrates between the tubes.

BRIEF DESCRIPTION OF THE DRAWINGS

The essence of the invention is explained in the drawings, where.

DETAILED DESCRIPTION OF THE PREFERRED EMBODIMENT

Figure 1:
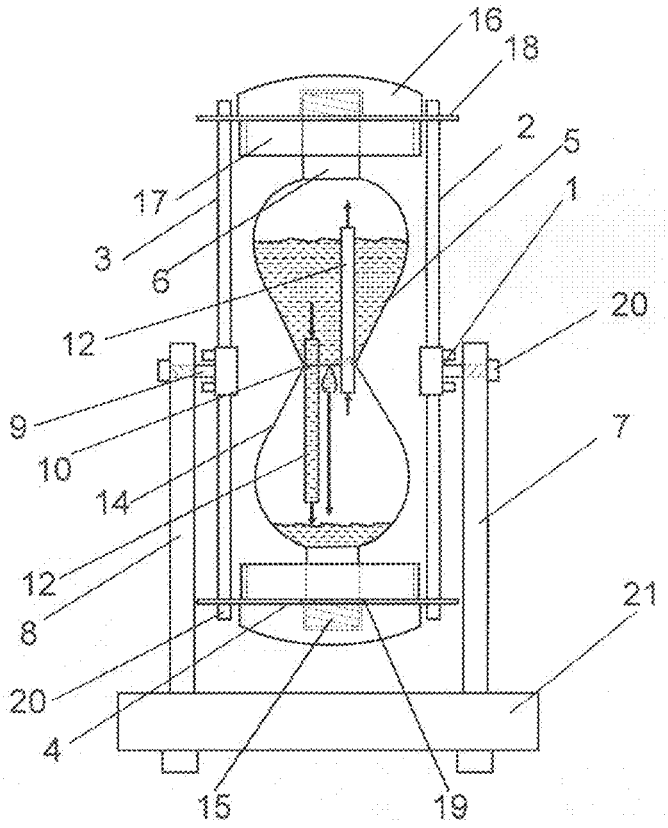
FIG. 1.—General view of the holder with the bottle.
Figure 2:
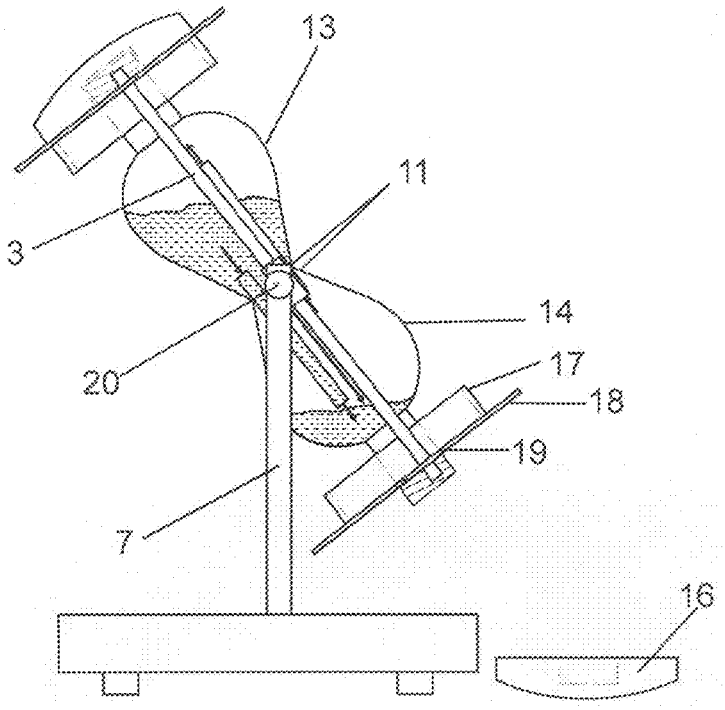
FIG. 2—View of the holder with the bottle with the frame turned about the axis of the holder.

The holder with the bottle 1 consists of the holder 7, the bottle 5, the frame 2. The frame 2 contains vertical rods 3 installed between two support platforms 4. Inside the frame 2 there is a bottle 5 for liquid with two necks 6, one neck being at the upper end of the bottle and another neck being at the lower end of the bottle. The bottle 5 is fixed to the frame 2 through the support platforms 4. The frame 2 is fixed on the holder 7 via a top portion of the axes 8 with the possibility of rotation about the holder 7 due to the swing joint 9. (see FIG. 1, 2).

The bottle 5 is made in the form of two connecting vessels 13, 14, the vessels comprising pear-shaped truncated cones connected at their peaks (i.e., rims) 11. Vessels 13, 14 of the bottle 5 are pear-shaped and connected at the middle of the bottle 5. Inside the bottle 5, two tubes 12 are fixed at the place of the vessels' communication (i.e., the vessels' connection) 10, the large (i.e. longer) end of the first tube 12 goes into the upper vessel 13, and the large (i.e. longer) end of the second tube goes into the lower vessel 14, ensuring the air pressure on the poured liquid. Tubes 12 are fixed (e.g. by soldering) in the place of vessels' communication (i.e. connection) 10 in such a way that the liquid penetrates between the tubes 12. Both necks 6 of the bottle 5 have a threading 15 for screwing the closing/opening element 16. The closing/opening element 16 may also have a closure system for the neck 6 with a cork (not shown in the figure). (see FIG. 1, 2).

Each support platform 4 of the frame 2 is made of an inner hollow cylinder 17 where a larger diameter disc 18 with an opening 19 in the central portion is disposed. The central hole 19 of the disk 18 is formed so that the neck 6 of the bottle 5 can pass through it. On the outer side of the disc 18 of each support platform 4 of the frame 2, an additional element 16 is provided which allows opening/closing of the bottle's neck 6 by, for example, screwing/sealing. The rods 3 of the frame 2 are fixed to the discs 18 of the support platforms 4, with a bolted joint 20, for example. (see FIG. 1, 2).

The holder 7 has a support stand 21, and the swing joints 9 of the holder 7 with the frame are designed to secure the frame with the bottle in the desired position relative to the axis of the holder 7 by another bolted joint 20 (see FIG. 1, 2).

The device works as follows:

1. The bottle is pre-filled with a liquid (drink) through one of the necks and is closed by the additional external element of the support platform.

2. The liquid is poured into other vessels from any of the necks of the bottle, for this, the frame with the bottle is rotated about the axis of the holder at the angle, which is necessary for the fluid intake. Then the frame is fixed with the bottle. Next, the additional external element of the support platform is unscrewed/unlocked and the liquid is poured.

3. After this, the frame with the bottle is rotated to its home position. In this case, if there is more liquid in the upper vessel of the bottle than in the lower vessel of the bottle, it seeps between the tubes and also into the tube located with its longer end in the lower vessel and through the second tube, which is located with its longer end in the upper vessel. As air is pumped from the lower vessel, being pushed out by the filling liquid, this air creates pressure on the liquid in the upper vessel.

Maintenance:

The holder with bottle does not require special maintenance.

If the liquid in the bottle is changed, then the bottle is removed from the support platforms of the frame and thoroughly washed.

If the holder is stored in a humid room, then it is necessary to lubricate the bolt of the bolted joint and the swing joints.

The proposed design has the following advantages over the prototype:

1. Ease of use.
2. Originality of the production.
3. Enhancement of functionality.

The proposed device can be used in public catering (bars and restaurants), as well as in everyday life.

The technical task, the solution of which is to create the claimed device, namely, the creation of a holder with a bottle that provides liquid pouring out from the top or bottom side of the bottle, secures the bottle fixation in the desired position in order to control the liquid pouring rate, and also provides a liquid transfusion from one of the connecting vessels to another at a predetermined rate, is solved, the result is achieved.

All of the aforesaid indicates the fulfillment of the technical task and the industrial applicability of the claimed device.

LIST OF POSITIONS

1. Holder with the Bottle
2. Frame
3. Vertical rod of the Frame
4. Support Platform
5. Bottle (upper vessel)
6. Neck
7. Holder
8. Axis of the holder
9. Swing joint
10. Connecting vessels
11. Peaks of connecting vessels (i.e., rims, or truncated portions of vessels)
12. Tube
13. Upper vessel of bottle
14. Lower vessel of bottle
15. Threading
16. Closing/opening element (additional element of the supporting platform)
17. Hollow cylinder
18. Disc (of the Frame)
19. The central hole of the disc
20. Bolted joint
21. Supporting stand

What is claimed is:

1. An apparatus with a bottle, comprising:

a frame, the frame comprising vertical rods installed between two support platforms within which a bottle for liquid is housed, the bottle having two necks, the bottle being attached to the frame through the support platforms, the bottle being made in a form of two connecting vessels, an upper vessel and a lower vessel, connected to each other at their rims, the frame being fixed on an axis of a holder, the frame being fixed to two swing joints, the swing joints each comprising a bolt inserted into an opening on either side of the holder, the bolt being rotatable within each opening, the bolt being fixed to the frame, thus providing rotation of the bottle about an axis of the holder, wherein one neck of the bottle is located at a lower end of the bottle and another neck of the bottle is located at an upper end of the bottle, wherein an external element is located on each of the support platforms providing for opening and closing of each neck, wherein the holder has a support stand, the swing joints being adapted to fix the frame with the bottle in a desired position relative to the axis of the holder, and wherein a first tube and a second tube are positioned inside the bottle at a place where the vessels connect, wherein the first tube has a longer end in the upper vessel, and the second tube has a longer end in the lower vessel, wherein a length of each tube creates a pressure upon a liquid within each vessel when the bottle is rotated, the tubes being fixed at the place where the vessels connect, the tubes being fixed such that the liquid penetrates through the tubes and between the tubes.

* * * * *